US009801254B2

(12) United States Patent
Hsing et al.

(10) Patent No.: US 9,801,254 B2
(45) Date of Patent: Oct. 24, 2017

(54) BACKLIT LUMINOUS STRUCTURE WITH UV COATING

(71) Applicant: Disney Enterprises, Inc., Burbank, CA (US)

(72) Inventors: Alexander W. Hsing, Glendale, CA (US); Lanny Smoot, Thousand Oaks, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 429 days.

(21) Appl. No.: 14/573,930

(22) Filed: Dec. 17, 2014

(65) Prior Publication Data

US 2016/0183346 A1 Jun. 23, 2016

(51) Int. Cl.

| | |
|---|---|
| ***H05B 33/14*** | (2006.01) |
| ***H05B 33/10*** | (2006.01) |
| ***F21V 9/16*** | (2006.01) |

(52) U.S. Cl.

CPC ..... *H05B 33/145* (2013.01); *H05B 33/10* (2013.01)

(58) Field of Classification Search

CPC ..... H05B 33/145; H05B 33/10; F21V 9/16
See application file for complete search history.

(56) References Cited

U.S. PATENT DOCUMENTS

| | | | |
|---|---|---|---|
| 2,921,218 | A | 1/1960 | Larach et al. |
| 5,149,568 | A | 9/1992 | Beck |
| 5,504,661 | A | 4/1996 | Szpak |
| 6,406,803 | B1 | 6/2002 | Abe et al. |
| 6,424,326 | B2 | 7/2002 | Yamazaki et al. |
| 7,144,289 | B2 | 12/2006 | Murasko et al. |
| 7,148,623 | B2 | 12/2006 | Vlaskin et al. |
| 7,211,838 | B2 | 5/2007 | Miyazawa |
| 7,270,436 | B2 | 9/2007 | Jasper |
| 7,275,972 | B2 | 10/2007 | Wolk et al. |
| 7,326,435 | B2 | 2/2008 | Buckingham et al. |

(Continued)

FOREIGN PATENT DOCUMENTS

| | | |
|---|---|---|
| CN | 10202442 | 12/2007 |
| CN | 101201421 | 6/2008 |

(Continued)

OTHER PUBLICATIONS

Nelson, Ron , "Reinventing EL (Electroluminescent) Into the Mainstream Backlighting World", www.signindustry.com/electric/articles/2010-03-15-SignPricing.php3; last accessed Sep. 8, 2014, Mar. 15, 2010.

*Primary Examiner* — Joseph L Williams
(74) *Attorney, Agent, or Firm* — Dorsey & Whitney LLP

(57) ABSTRACT

The present disclosure relates generally to a backlit luminous structure. The backlit luminous structure includes a substrate, such as a two dimensional or three dimensional object or surface, an ultraviolet emitting electroluminescent coating or other type of UV emitting coating that emits ultraviolet wavelengths when activated, and an ultraviolet activated luminous coating applied on the ultraviolet emitting electroluminescent coating. When activated, the ultraviolet emitting electroluminescent coating generates ultraviolet wavelengths that aviate the luminous coating. The backlit luminous structure may be used in a variety of applications, such as, but not limited to, theme parks, amusement attractions, or the like.

24 Claims, 12 Drawing Sheets

(56) References Cited

U.S. PATENT DOCUMENTS

| | | | | |
|---|---|---|---|---|
| 7,482,747 | B2 | 1/2009 | Shin et al. | |
| 7,495,384 | B2 | 2/2009 | Hajto et al. | |
| 7,638,938 | B2 | 12/2009 | Aoyama et al. | |
| 7,733,310 | B2 | 6/2010 | Hajjar et al. | |
| 7,737,633 | B2 | 6/2010 | Zheng | |
| 8,287,760 | B2 | 10/2012 | Ishida et al. | |
| 8,405,100 | B2 | 3/2013 | Matsumoto et al. | |
| 8,470,388 | B1 | 6/2013 | Zsinko et al. | |
| 8,684,784 | B2 | 4/2014 | Schmidt et al. | |
| 2004/0183434 | A1 | 9/2004 | Yeh et al. | |
| 2005/0104509 | A1 | 5/2005 | Yamashita | |
| 2006/0066209 | A1* | 3/2006 | Chau ..... | C09K 11/0883 313/486 |
| 2006/0214577 | A1 | 9/2006 | Byrne | |
| 2006/0291186 | A1 | 12/2006 | Marcus et al. | |
| 2007/0188092 | A1 | 8/2007 | Lee et al. | |
| 2007/0278502 | A1 | 12/2007 | Shakuda et al. | |
| 2012/0299045 | A1 | 11/2012 | Pan et al. | |
| 2013/0184085 | A1 | 7/2013 | Clark | |

FOREIGN PATENT DOCUMENTS

| | | |
|---|---|---|
| JP | 7301798 | 11/1994 |
| WO | 2010043608 | 4/2010 |
| WO | 2014033484 | 3/2014 |

* cited by examiner

BACKLIT LUMINOUS STRUCTURE WITH UV COATING

FIELD

The present disclosure relates generally to luminous paint, and more specifically to ultraviolet activated luminous coatings.

BACKGROUND

Luminous paints, such as fluorescent paints, blacklight paints, and phosphorescent paints, include a wide range of pigments that glow or otherwise emit visible light when exposed to an energy source such as ultraviolet (UV) light radiation, e.g., wavelengths between 400 nm to 10 nm. Blacklight paints can be applied to a variety of surfaces so that those surfaces will glow in different colors when illuminated by UV light. The surface glows because the blacklight paint converts UV wavelengths into visible wavelengths. For example, blacklight paints may be painted on surfaces of dark amusement rides in theme parks or entertainment parks to create a glow-in-the-dark effect.

Blacklight paints generally require the use of external UV sources, such as UV light emitting diode (LED) strobes, UV lamps, or the like to provide the UV radiation. In certain instances, such as when used in entertainment attractions, these external UV sources may often be required to be hidden from being viewed by guests to maintain the aesthetics and experience of the attraction.

Additionally, for complex or irregular surfaces multiple UV lamps may be needed to light the surfaces from various angles and locations to ensure uniform exposure to the UV radiation and thus a uniform luminous appearance. FIG. 1A is a simplified diagram illustrating a flat surface glowing in the dark with external UV sources. As shown, three external UV sources 102A-C are placed at different angles and locations from the surface 104, which is covered with blacklight paint. When the UV sources 102A-C are turned on, the 2D surface 104 glows due to the reaction with the UV sources. FIG. 1B is a simplified diagram illustrating a three dimensional surface glowing due to the UV emitted from the external UV sources. As shown, the three dimensional (3D) surface 106 glows when three external UV sources 102A-C emit UV radiation that impacts the 3D surface 106. The multiple UV sources are required for the 3D surface to ensure that every curve and shape of the structure receives the UV radiation and emits a uniform level of light. Because the UV wavelengths emitted from the UV lights are typically invisible to humans, the illuminated surfaces appear to "glow in the dark" when visible light sources are turned off or not present.

Even with multiple UV sources, light uniformity may still be a problem for illuminating very curved or convoluted surfaces because the complex geometry or shapes of the objects may prevent UV light from being received in certain areas. That is, certain structures of the shape block the UV radiation emitted from the external UV source from reaching other areas. This limits the creative freedom or flexibility by artists. Also, people and other structures cannot get close to these surfaces as anything casting a shadow may prevent the UV light emitted from the UV source from reaching the blacklight paint, which may then cease to glow.

External UV sources also do not allow precise illumination control, such as to illuminate small details such as a nose of a face of character. This is because the light emitted from an external source is likely to bleed onto other areas of the surface.

Additionally, UV light or radiation from external UV sources may also inadvertently cause other items to change in appearance or glow. This side effect may adversely impact the aesthetics of an application, such as dark theme park rides that include blacklight painted surfaces. For example, white shirts may glow in the dark if exposed to UV light in a dark setting as typically white shirts may be laundered with a bleaching agent, such as detergent containing bleach. This bleaching agent may glow when exposed to UV light, because many bleaching agent contain chemicals that emit visible light when exposed to UV light. This inadvertent glowing in certain environments, such as theme parks, may diminish an intended artistic effect, as the artist may wish that only the object of interest glows in the dark environment and that other objects.

UV light from external UV sources may also scattered onto people's faces, which may enhance the visibility of some undesirable characteristics. For example, dirt on a person's teeth may be visible in a dark setting when the UV light is scattered onto the person's face, as the person's teeth absorb the UV light and reemit light having a longer wavelength, i.e., visible light, causing the teeth to glow.

It is with these shortcomings in mind that the present disclosure has been developed.

SUMMARY

The present disclosure relates generally to a backlit luminous structure. The backlit luminous structure includes a UV activated paint or ink and a UV emitting layer positioned beneath the UV activated paint or ink layer. Because the UV radiation that activates the UV activated paint is emitted from the same structure as the paint, the UV radiation can be applied uniformly to the paint, even if the structure has a complex geometry. Alternatively the UV light concentration can be varied to different regions of the paint to selectively activate certain painted regions or to vary the intensity of certain painted regions as compared to others.

In one embodiment the backlit luminous structure includes a substrate, an ultraviolet emitting electroluminescent coating deposited over the substrate, and a UV activated luminous coating, such as fluorescent paint, blacklight activated paint, or the like, applied to the UV emitting coating.

In some embodiments, the UV emitting coating may be divided into a plurality of regions such that each of the regions may be selectively activated separate from one another. In this embodiment, the UV light may selectively activate certain regions of the luminous coating.

In another embodiment, an illumination system for an object is disclosed. The illumination system includes an UV emitting structure including a plurality of selectively activatable UV regions, a blacklight paint coat applied on top of the UV emitting structure, a power source electrically coupled to the plurality of UV regions, and a controller electrically coupled to the power source to selectively activate UV emission from each UV region.

In yet another embodiment, the present disclosure includes a method for forming a fluorescent illuminating object. The method include applying an ultraviolet emitting coating onto a substrate, where the ultraviolet emitting coating includes a phosphor layer and applying UV activated pigments over the UV emitting coating.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure.

SPECIFICATION

Overview

Figure 1A:
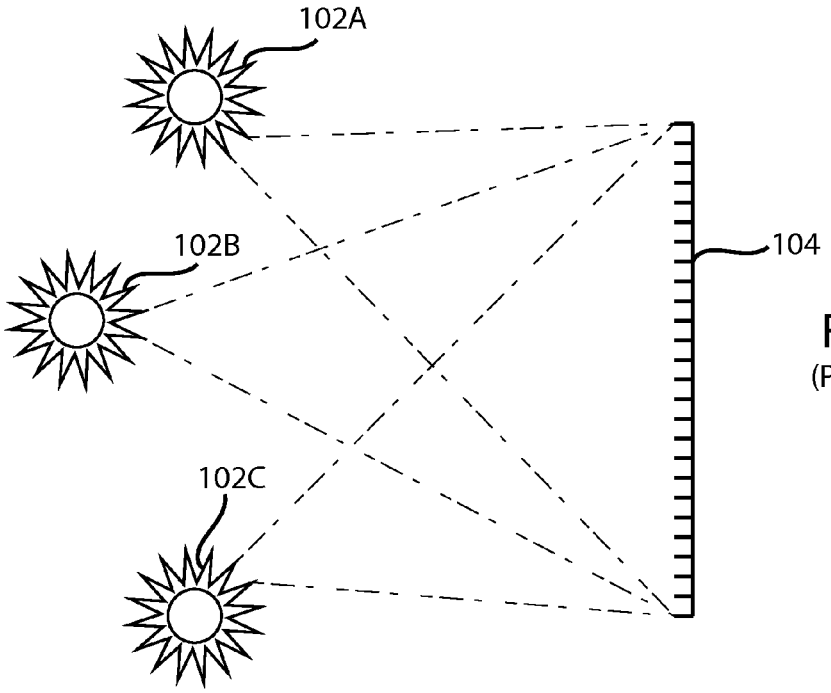
FIG. 1A (PRIOR ART)
FIG. 1A is a simplified diagram illustrating a surface emitting visible light by being exposed to external UV sources.
Figure 1B:
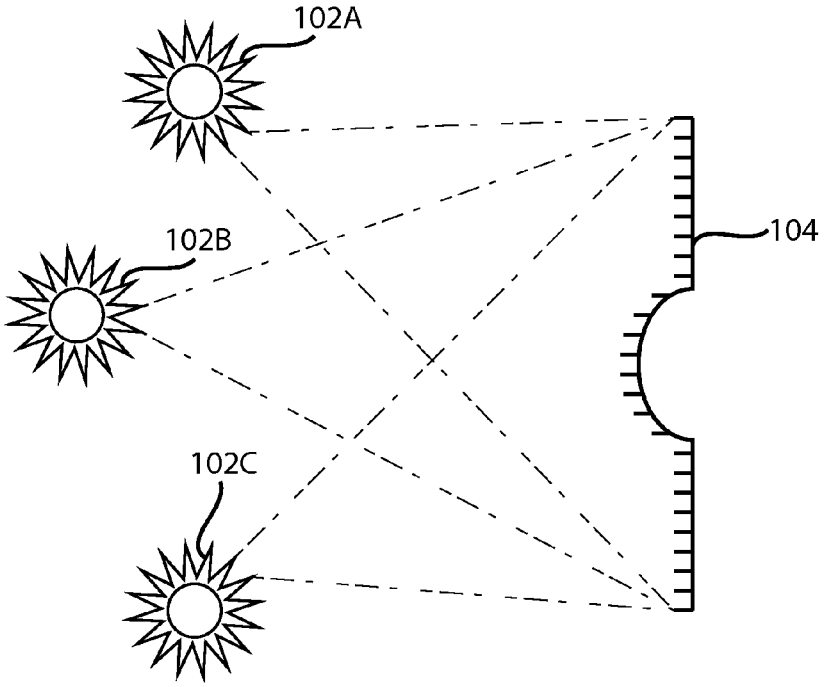
FIG. 1B (PRIOR ART)
FIG. 1B is a simplified diagram illustrating a 3D surface emitting visible light by being exposed to external UV sources.

The present disclosure relates to a system including a backlight structure for a luminous coating that can be applied to various surfaces, including 3D and irregularly shaped surfaces to uniformly and accurately create a luminous or glowing surface. The disclosure described herein uses a UV emitting coating or structure, such as an electroluminescent (EL) coating, that is applied beneath a luminous paint or ink, such as fluorescent or blacklight paint. The UV emitting coating can be electrically activated and applied to various surfaces, including surfaces with complex geometries.

In embodiments where the UV emitting coating is an EL coating, the coating includes phosphors or other types of electroluminescent materials that emit light in response to the passage of an electric current or a strong electric field, such as AC current. Because the UV emitting coating is positioned beneath the fluorescent paint, when activated, the EL materials within the emit radiation that falls within the UV spectrum, which in turn activates the fluorescent paint and causes the fluorescent paint to absorb the UV wavelengths and emit visible light.

In other embodiments, the UV emitting coating may include other UV light sources, such as, but not limited to, light emitting diodes (LEDs), organic light emitting diodes (OLEDs), inorganic micro LEDs, light emitting capacitors (LECs), or the like. In these embodiments, the electroluminescence in the form of UV light is emitted in response to an electrical stimulus, such as a voltage.

To create a glowing object or surface, the UV emitting coating system may be applied to a surface to provide one or more UV light sources on top of the surface. Artwork may be applied to the surface with blacklight paint or fluorescent paint, which can then be backlit by the UV emitting coating system. The surface can be either flat, or a two-dimensional (2D) surface, such as a panel, or a 3D surface complex surface. The backlit structure allows the fluorescent paint on the 2D or 3D surface to be activated and "glow," without requiring externally positioned UV light sources.

The present disclosure also provides a method for controlling the fluorescent activation of a 2D or 3D surface in selected or specific areas by selectively activating the UV emitting structure. In one embodiment, the surface may be sectioned into various regions or partitions that are electrically separated, such that each section or region may be controlled independently to emit light at different times and/or at different intensities. For example, the phosphors or active materials may be electrically activated to provide UV light in the areas corresponding to the activated UV emitting coating and those areas may light up or dim, whereas adjacent areas that are not positioned above the activated sections of the UV emitting coating may not be lit. The present technology opens up a range of new applications for fluorescent and other luminous paints for artists by providing the ability to control light activation at any selected regions, including very narrow areas, within a surface. This type of precision was difficult, if not impossible to achieve with external UV light sources.

Additionally, in some embodiments, additional output enhancers, such as reflectors or additional conductors, may be added to the backlit luminous structure to enhance or inhibit the brightness and/or contrast in certain regions of the luminous paint.

It should be noted that the terms "blacklight paint" or "fluorescent paint" as used herein are meant to encompass substantially any type of luminous inks, paints, and other similar materials, such as, but not limited to, fluorescent paint, blacklight-reactive paint, phosphorescent paints, or the like, that emit visible light wavelengths when exposed to radiation in the UV spectrum.

Detailed Description

Figure 2A:
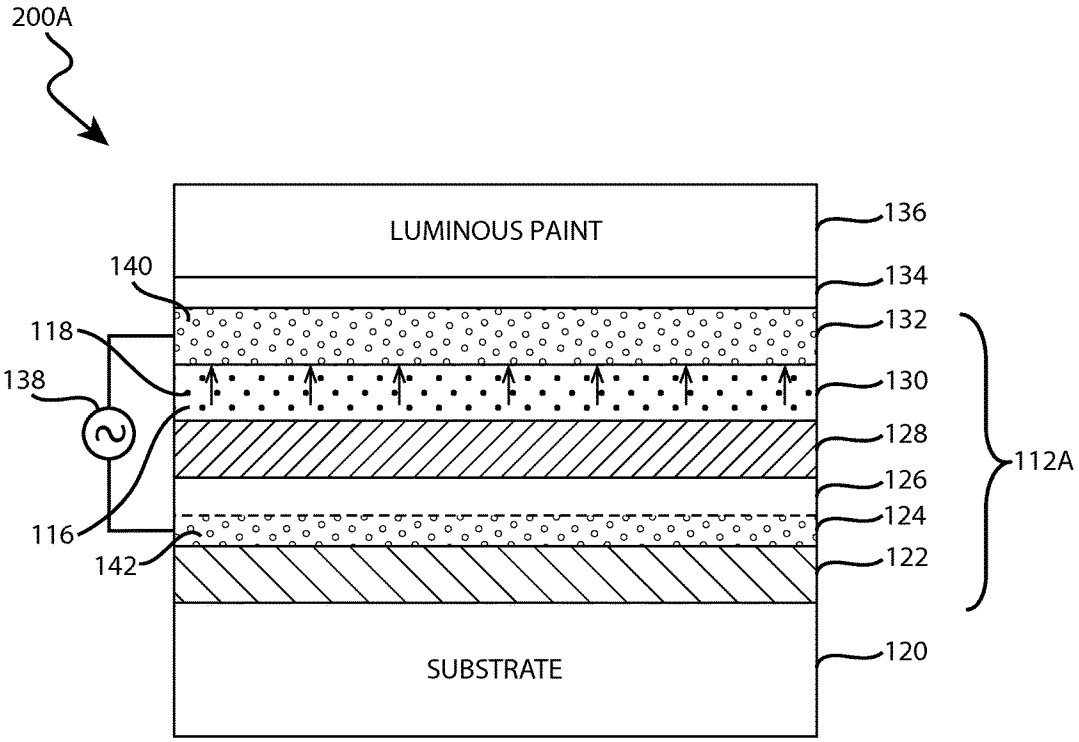
FIG. 2A is a cross-sectional view of a backlit luminous structure according to a first embodiment of the present disclosure.

With reference again to the figures, the backlit luminous structure including a UV emitting coating will now be discussed in more detail. FIG. 2A is a cross-sectional view of a backlit luminous structure in accordance with a first embodiment of the present disclosure. In this embodiment, a substrate is coated with UV emitting coating and fluorescent paint. The backlit luminous structure 200A may include a UV emitting coating stack 112A disposed between a fluorescent paint 136 layer and a substrate 120. The UV emitting coating stack 112A includes UV emitters, such as phosphors 118, to provide a UV radiation source for the fluorescent paint 136. In particular, when an electrical power source, such as AC or DC power source, is applied, the phosphors 118 are activated and emit UV radiation to activate the fluorescent paint.

The UV emitting coating stack is sufficiently configured to allow light emitted from an emission layer to be transported to and reach the blacklight paint 136. For example, one or more elements within the coating may be transparent to UV light. In one embodiment, the UV emitting structure 112A includes a front electrode 132 and a top clear coat 134, both of which do not block UV light, i.e., transparent to UV light, such that the UV light emitted from the phosphors can be transmitted to the fluorescent paint 136 without substantial attenuation.

The UV emitting coating stack or system 112A may include at least six layers to form a capacitor-like structure. Specifically, the UV emitting coating stack 112A may include an electrically insulating base layer or sheet 122 and a bottom/back conducting layer 124 over the insulating base layer 122, which forms the first electrode. The bottom conducting layer may include conductive particles 142 mixed with a polymer resin binder. The UV emitting coating stack 112A may also include a dielectric layer 128 over the bottom/back conducting layer 124 to prevent short circuits.

The UV emitting coating stack 112A may optionally include a layer of one or more bus bars 126, traces, or other electrical communication pathways, between the bottom conducting layers. The bus bars 126 may help distribute the current over the surface of the substrate or object more evenly.

On top of the dielectric layer 128, the UV emitting coating stack 112A may also include an active UV emitting layer 130, which in one embodiment is an EL coating and contains phosphors 118 mixed with an insulating polymer binder 116.

The UV emitting coating stack 112A may also include a front or top conductive layer 132 that is transparent to UV light and forms a second electrode. The top conductive layer 132 includes conductive particles 140 mixed with a polymer binder. The particle sizes in the resin may be smaller than the UV wavelengths being transmitted from the emitting layer, so that light scattering may be reduced or minimized. To activate the phosphors 118, power is applied to the first electrode 124 and second electrode 132, providing current to the phosphors 118.

The UV emitting coating stack 112A may further include an electrically insulating protective clear coat layer 134 on top of the front conducting layer 132. The clear coat layer 134 is used to protect the other layers from environmental damage. In many embodiments the clear coat layer 134 is transparent in order to reduce attenuation of the UV light transmitted therethrough. For example, an automotive clear coat paint, such as PPG CeramiClear or Rustoleum Autobody Clear, or other UV transparent paints may be used. Additional protective clear coat layers may be used for some applications, as long as each of the clear coat layers transmits UV light, or does not cause a large attenuation in the UV light as it is transmitted therethrough. The UV light generated from the active UV emitting layer 130 is transmitted through the top conducting layer 132 and the clear coat layer(s) 132 to cause the fluorescent paint 136 to emit visible light when the UV emitting layer 130 is electrically activated.

The backlit luminous structure 200A may also include a power source, such as an alternating current (AC) power source 138 that activates the UV emitting coating. AC power may be used in instances where the EL system is a capacitive type structure, but in other embodiments, such as with LEDs or other light sources DC power may be used. After the UV emitting coating stack or system 112A has been applied to the substrate 120, an artist applies fluorescent paint to create artwork on top of the UV emitting coating to complete the backlit luminous structure 200A. The fluorescent paint 136 can be applied directly on the top clear coat layer 134 and/or may form the top layer for the UV emitting coating, i.e., the top clear coat layer may be omitted and the fluorescent paint may be applied to the top conductor.

When the power 138 is switched on, the UV emitting coating stack 112A emits UV light, causing the fluorescent paint 136 to glow as it emits visible light. The use of the backlit luminous structure eliminates the need for external UV lamps as the UV light is produced internally within the structure and is positioned beneath the blacklight or fluorescent paint.

The bottom conducting layer 124 may be cut or otherwise modified to form isolated or electrically separated regions, where each of the regions can be activated independently. The insulating lines that delineate different regions on the surface may be wide enough to provide sufficient insulation between different regions. Optionally, a dielectric or other insulating material may be added to fill between each of the regions to provide sufficient insulation between each regions.

The fluorescent paint 136 is activated or lit with UV light from its backside by the UV emitting coating system 112A. In particular, when the coating is activated, the phosphors 118 in the active layer 130 emit a broad spectrum of UV wavelengths which in turn cause the fluorescent paint 136 to emit a broad spectrum of visible light. The UV light emitted by the UV emitting layer may have wavelengths shorter than 400 nm and in some embodiments, the wavelength of the UV source may be near 340 nm, 360 nm, or 380 nm.

The phosphors 118 used may be those such as the phosphors produced by Intelligent Materials Solutions among other suppliers. For example, the phosphors may provide upconversion luminescence using rare-earth doped nanocrystals. The upconversion luminescence may be based on the absorption of two or more low-energy (longer wavelength, typically infrared) photons by a nanocrystal followed by the emission of a single higher-energy (shorter wavelength) photon. In these phosphors, the energy transfer is accomplished by using a combination of rare-earth lanthanides as dopants on ceramic microparticles. Additionally, in these examples the upconversion luminescence may not occur in nature and may be opposite from the normal fluorescence that converts higher-energy or shorter wavelength light to lower-energy or longer wavelength emitted light.

The ability to adjust the size, morphology, absorption, emission, rise time, decay time, power density, and other properties of upconversion nanocrystals enables the formation of materials with an infinite amount of distinctive signatures. Upconversion crystals and nanocrystals with sizes ranging from 5 nm to 400 microns have been prepared, and the morphology of the crystals can be spherical, hexagonal, cubic, rod-shaped, diamond-shaped, and random.

In some embodiments, the concentrations of the nanocrystals may be varied to vary the emission characteristics. This variation may be used to provide a desired artistic effect for the backlit luminous structure.

In some embodiments, the nanocrystals are synthesized using specific compositions of individual rare earths and other host elements. These nanocrystals allow the conversion of various wavelengths of light energy up and down the electromagnetic spectrum. The upconversion luminescence by the nanocrystals occurs through a combination of a trivalent rare-earth sensitizer (e.g. Yb, Nd, Er, or Sm) as the element that initially absorbs the electromagnetic radiation and a second lanthanide activator (e.g. Er, Ho, Pr, Tm) ion in an optical passive crystal lattice that serves as the emitting elements. By varying the concentrations and ratios of rare earths, different emission spectra can be elicited from the same combination of elements. The rare earth-doped nanocrystals are of small size, high quantum efficiency, and high photo luminescent intensity functionalized. The upconversion nanocrystals do not photobleach and allow permanent excitation with simultaneous signal integration. They can be stored indefinitely without a decrease in light emitting efficiency and thus allow repeated irradiation and analysis.

Figure 2B:
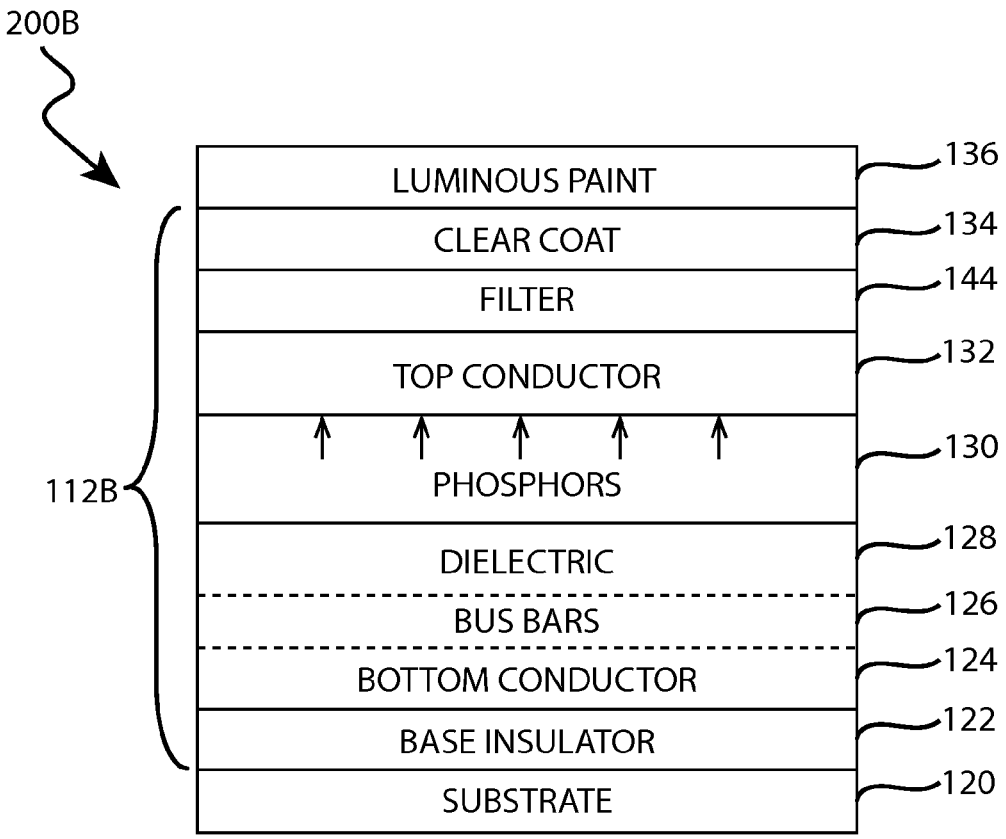
FIG. 2B is a cross-sectional view of a backlit luminous structure in accordance with a second embodiment of the present disclosure.

Another example of a backlit luminous structure will now be discussed. FIG. 2B is a cross-sectional view of another example of the backlit luminous structure. In this example, the backlit luminous structure 200B includes a UV emitting coating stack 112B having one or more filters 144 positioned therein. The filter 144 may be positioned between the front conducting layer 132 and the clear coat layer 134. In use, the phosphors 118 may emit various wavelengths including UV light and visible light. The filter 144 may be used to block or eliminate the visible light emitted by the phosphors 118 by only passing or transmitting the UV light or select wavelengths of light. The filter 144 may help reduce any color shift due to visible wavelengths being emitted from the UV emitting coating stack and to ensure that a desired artistic effect is created without accidental visible light reaching the fluorescent layer.

The filter 144 may be substantially any type of optical filter that filters specific wavelengths to allow only the desired wavelengths to be transmitted therethrough. For example, the filter 144 may be an absorptive filter that absorb the undesired wavelengths, interference or dichroic filter, band pass filter, one or more optical coatings, or the like. The type of filter and number of wavelengths transmitted through the filter 144 may be varied based on the artistic effect desired. In embodiments where multiple filters 144 are used, each filter 144 may transmit/block the same wavelengths as the other or the filters 144 may be set to transmit/block different wavelengths from each other.

In some embodiments, one or more components of the backlit luminous structure may include reflective properties. For example, a material having reflective characteristics may be positioned beneath the phosphor or UV emitting layer so that any UV light traveling away from the luminous paint coating 136 will be reflected towards the coating 136. This helps to ensure that substantially all of the UV light emitted by the UV emitting layer reaches the luminous paint coating 136 so as to active the coating. For example, the substrate 120 may be formed of or coated with a reflective material to reflect UV light away from the substrate 120 and towards the luminous pain 136.

Figure 2C:
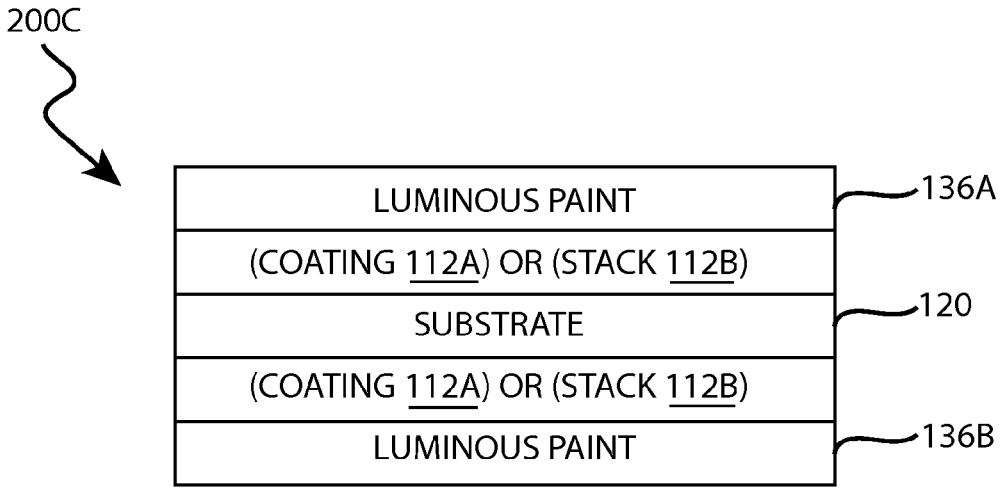
FIG. 2C is a cross-sectional of a backlit luminous structure with a UV emitting layer coated on two sides with a luminous paint in accordance with embodiments of the present disclosure.

FIG. 2C is a cross-section of the backlight luminous structure having two surfaces coated with fluorescent paint in accordance with embodiments of the present disclosure. As shown, configuration 200C may include a substrate 120 having a fluorescent paint 136A on the top and a fluorescent paint 136B on the bottom. A UV emitting coating stack 112A or 112B may be placed between the substrate 120 and the fluorescent paint 136A or 136B. This configuration may be useful for objects that may need to light up on both surfaces, such as leaves or plants.

Figure 3A:
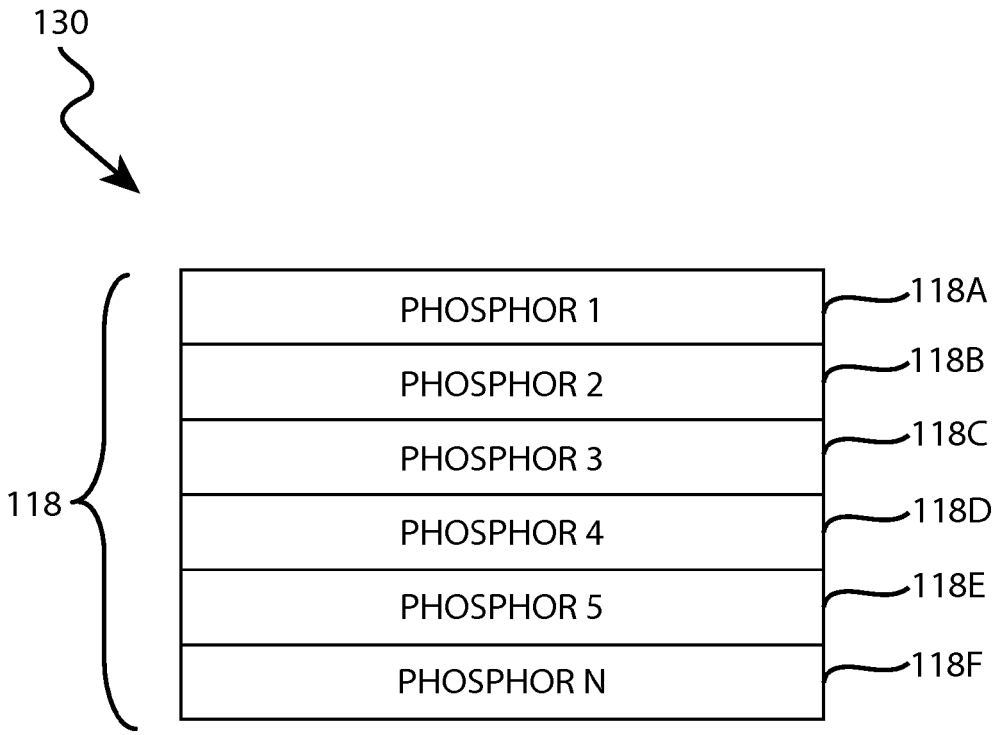
FIG. 3A is a cross-sectional view of multiple phosphor layers for the UV emitting layer in accordance with one embodiment of the present disclosure.

FIG. 3A is a cross-sectional view of a UV emitting coating including multiple phosphor layers in accordance with one embodiment of the present disclosure. Multiple phosphors may be used to provide sufficient output in the ultraviolet range. As an example, the active layer 130 may include a number of phosphors, such as 118A, 118B, 118C, 118D, 118E, in a number of phosphor layers. Each of the phosphor layers containing one of phosphors 118A-E may be applied sequentially to form a stack. The phosphor layers may include phosphors that emit wavelengths different from other layers or may emit similar wavelengths as the other layers.

Figure 3B:
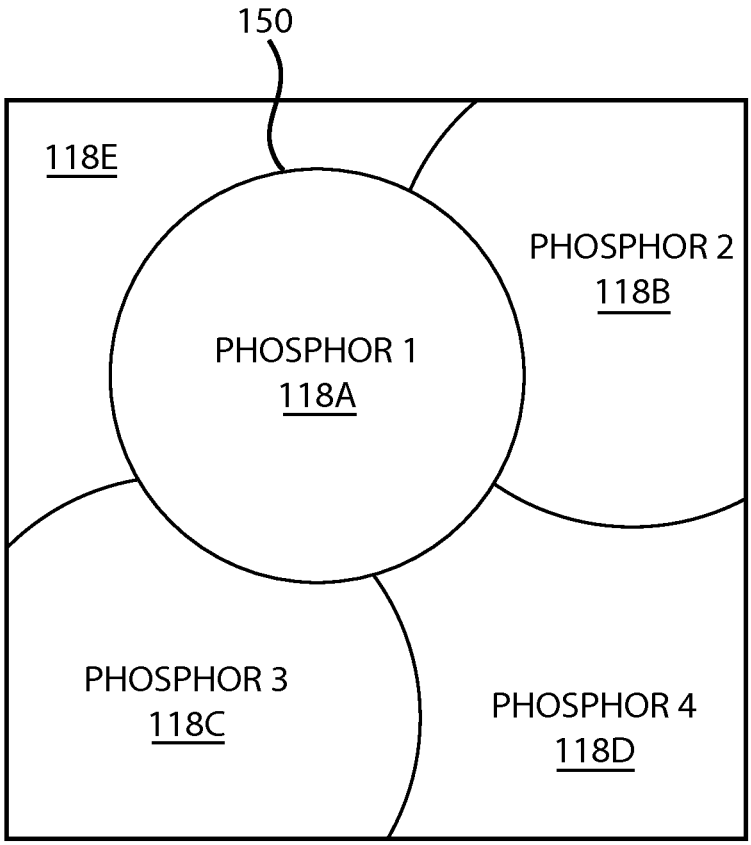
FIG. 3B is a top view of multiple phosphors positioned in different regions of the UV emitting layer in accordance with embodiments of the present disclosure.

Alternatively or additionally, multiple phosphors 118A-E may be applied to different regions on a 2D or 3D surface. FIG. 3B is a top view of the multiple phosphors in accordance with embodiments of the present disclosure. As shown, phosphors 118A-E may be applied to five regions separated by contour 150 in a single layer. The concentration of phosphors 118A-E in each region may vary. For example, to enhance brightness in selected areas, one may apply phosphors with higher or lower phosphor concentrations or that emit different UV wavelengths, depending upon the need or desired artistic effect. It will be appreciated by those skilled in the art that each region may include more phosphors in multiple layers. The regions may vary in shape.

Referring to FIG. 2A again, depending on the size of the surface or object being coated, one or more bus bars 126 may be added to the backlit luminous structure. The bus bars 126 are electrical communication pathways or strips or conductive material positioned between the bottom conductive layer 124 and the dielectric layer 128. The bus bars 126 may be formed of highly conductive materials and are used to help promote even current distribution throughout the surface of the object. Alternatively, other methods or components may be used that enhance the uniformity of the current distribution.

The bus bars 126 may be positioned in various locations within the backlit luminous structure, but generally may be positioned in areas on the substrate where the current may not be evenly distributed, such as at the end locations, center regions of the structure, or around 3D shaped structures on the substrate. The bus bars may also be positioned at locations where a brighter UV emission is desired. In these embodiments, the bus bars may in a sense amplify the current provided to a certain region of the UV emitting coating to enhance the "glowing" effect of the fluorescent paint. That is, the bus bars may be positioned to increase the current provide to the UV emitting coating to encourage a stronger UV emission from the coating to increase the visible output of the fluorescent paint layer to accentuate the particular area or region, e.g., light up the nose of a character painted with the blacklight paint with a brighter glow than the other areas of the character.

Figure 4:
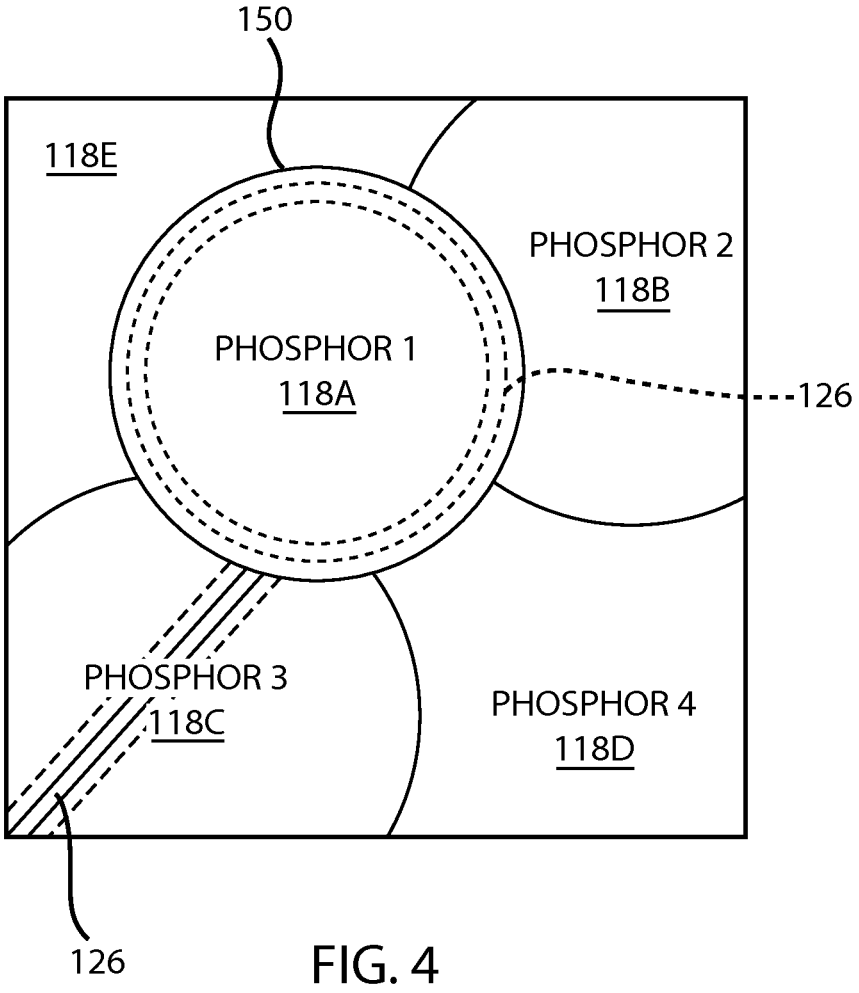
FIG. 4 is a top view of the UV emitting layer of FIG. 3B with two bus bars positioned therein in accordance with embodiments of the present disclosure.

FIG. 4 is a top view of bus bar patterns in accordance with embodiments of the present disclosure. The bus bars 126 may be located through areas that may require additional current distribution in order to more evenly distribute the current. Additionally or alternatively, the bus bars 126 may be positioned around a specific region that corresponds to a desired illumination effect of the blacklight paint. As shown in FIG. 4, the conductor around borders may be relatively thick or wide to have very low resistance such that sufficient current may be provided to selected areas and in areas requiring more current the bus bars 126 extend therethrough.

In some embodiments, the conductor positioned between the different phosphor regions may be segregated to define areas luminous glowing and non-glowing regions. For example, the conductor may be segmented with insulating non-conductive materials positioned between illuminating and non-illuminating regions. By using the bus bar 126 and/or segmenting the conductor layer as desired, different regions of surface may be configured to emit varying levels of visible light as well as non-glowing regions may be positioned within a region or between multiple regions of visible light emitting sections. This allows an artist to have extensive creative control over the overall effect and appearance of the backlit luminous structure.

Additionally or alternatively, the outer appearance of the backlit luminous structure may be varied by changing at the reflective properties and/or the conductive properties of one or more layers of the backlit luminous structure 200. For example, to create a brighter appearance for certain portions of the luminous paint 136, reflectors may be positioned on the substrate or otherwise located within the stack beneath the select portions of the luminous pain 136. When the backlit luminous structure is activated, the select portions above the reflectors will appear brighter as more UV light reaches the luminous paint as compared to other regions due to the reflectors reflecting stray UV light back towards the surface.

In another example, additional conductive materials may be added beneath certain portions of the luminous paint within the backlit luminous structure. When powered, the phosphor layers positioned above the additional conductors will be more strongly activated, producing more UV light, increasing the brightness, contrast, and other visible characteristics of the luminous paint appearance in those areas.

Increasing the conductive or reflective properties of components within the backlit structure allows for an increase or decrease in output characteristics, such as brightness or contrast, of the structure. For example, increasing the conductive/reflective properties will increase the brightness, whereas decreasing the conductive/reflective properties will decrease the brightness. In other words, varying the reflective and/or conductive properties of materials within the backlit luminous structure will vary the outer appearance of the luminous paint and can be used to create a desired artistic effect. The reflectors or conductors may be added as particles or pieces dispersed on another material, e.g., metallic components formed onto a plastic substrate. Alternatively the reflectors or additional conductors may form an entire layer, e.g., a metallic substrate.

Figure 5:
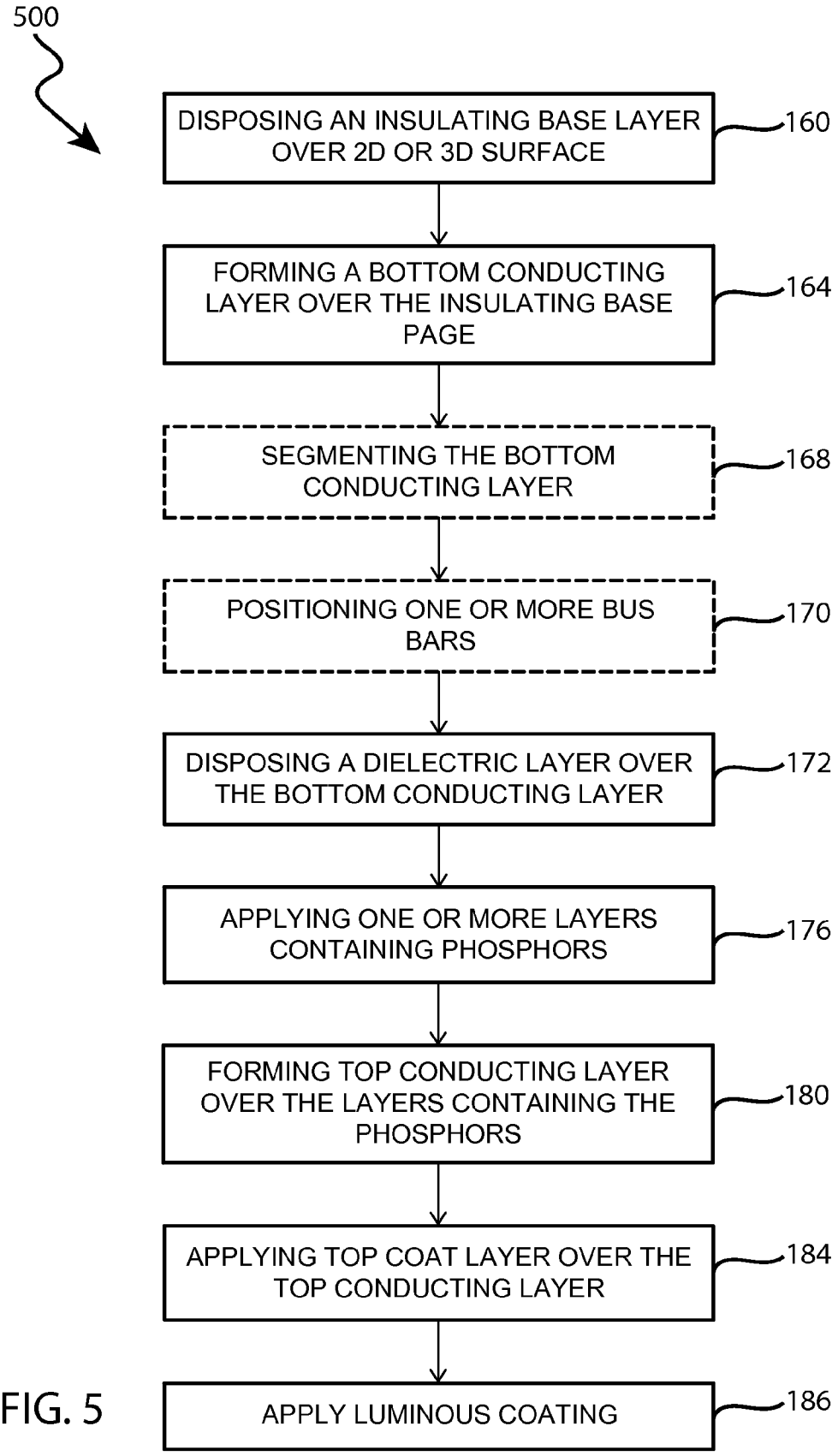
FIG. 5 is a flow chart illustrating a method for forming a backlit luminous structure in accordance with embodiments of the present disclosure.

FIG. 5 is a flow chart illustrating a method for forming a backlit luminous structure in accordance with embodiments of the present disclosure. The method 500 may include several operations for forming the backlit structure, such as shown in FIGS. 2A-2B. For example, the method 500 may begin with operation 160 and an electrically insulating base layer is disposed over a substrate. Once the base layer has been applied to the substrate, the method 500 may proceed to operation 164 and a bottom conducting layer is formed over the insulating base layer.

With continued reference to FIG. 5, after operation 164, the method 500 may proceed to optional operation 168. In operation 168, the bottom conducting layer may be segmented to divide the surface into a number of regions. As discussed above with respect to FIG. 4, one or more insulating non-conductive materials may be positioned between the various conductive regions to electrically isolate each region. Alternatively, the conductive regions may be spaced apart from one another by a gap to form the separate regions.

After operation 168, the method 500 may proceed to optional operation 170. In operation 170 one or more bus bars 126 may be positioned over the bottom conducting layer. The bus bars 126 may be arranged so to enhance current distribution in certain locations along structure and/or increase/decrease the current for certain regions based on the desired aesthetic appearance of the structure 200A, 200B.

After operation 170, the method 500 may proceed to operation 172. In operation 172, a dielectric layer is disposed over the bottom conducting layer and/or the bus bars 126. Once the dielectric material has been applied, the method 500 proceeds to operation 176 and one or more active layer(s) containing phosphors are applied over the dielectric layer at operation.

Once the phosphors have been applied to the structure, the method 500 may proceed to operation 180. In this operation 180, the top transparent conducting layer is formed or applied over the one or more active layers. With the top conducting layer in position, the method 500 proceeds to operation 184 and the transparent coat is applied on top of the top transparent conducting layer. With continued reference to FIG. 5, once the top clear coat has been applied, the method 500 may proceed to operation 186. In operation 186, the blacklight paint or other luminous coating is applied to the UV emitting coating to form the backlit luminous structure 200A, 200B.

It should be noted that various different application techniques may be used to apply the various layers to the substrate to create the backlit luminous structure. For example, screen printing, spraying, or thermoforming are some techniques that can be used, either alone or in combination with one another to apply, form, or dispose of one or more layers of the backlit luminous structure. The materials may vary, depending upon the type of technique used. These methods are described in more details below.

Screen Printing

Screen printing may be used for applying, disposing or forming one or more layer of the UV emitting coating. For example, a mesh stencil or other stencil is used to apply ink or other materials onto a substrate. The stencil defines openings to allow the transfer or ink or other printable materials onto the substrate at the desired location. For example, the ink or other printable materials may be pressed through the stencil onto the substrate. The areas of the stencil without holes or other passages prevent the ink or printable material from being deposited in certain regions. A fill blade or squeegee may be moved across the stencil, forcing the ink through openings to wet the substrate during a squeegee stroke. The substrate may have a 2D or a 3D surface.

The example materials for screen printing are provided below. The bottom conducting layer 124 may be formed from conductive paste, which may be a mixture of conductive particles and a polymer resin. The conductive paste may be chemically cured or UV cured. For example, the conductive particles may be silver particles for the bottom conducting layer. The conductive silver paste may include, but not limited to, Electra ELX30 from Electra, or DuPont 4929N among others.

The dielectric layer 128 is an insulating layer, which may be formed of a dielectric paste, such as Gwent White Dielectric paste D2070209P6 or ELX80 Ceramic Dielectric Paste from Chestech. The dielectric paste is heat curable or UV curable. In many embodiments it may be desirable to form a uniform dielectric film as pinholes or discontinuities in the dielectric film may cause the first and second electrodes 124 and 132 to short.

The active layer 130 containing phosphors 118 may be formed of polymer resin binder, such as Gwent Group R2070613P2, combined with UV phosphor(s) 118. The resin binder may be cured at an elevated temperature.

The top/front conducting layer 132 may include smaller conducting particles in a resin matrix. The top layer also needs to be as clear as possible to transmit light in UV wavelengths. The resin matrix is clear or transparent to UV lights. The conductive particles are added to increase conductivity. In some embodiments, non-transparent conductive particles may be added, such as silver nanowires as the conducting agent for the top conducting layer 132, due to its high conductivity and small sizes. The silver nanowires are small enough such that they do not scatter UV light. For example, a translucent conductor may be supplied by commercial companies, DuPont LuxPrint 7164, which can be used as the front electrode. Alternatively, the top/front electrode 132 may also use ELX-ITO-R Indium-Tin Oxide (ITO) from Electra, which is a transparent and conductive paste. The ELX-ITO-R ITO provides good adhesion to both polycarbonate and polyester films.

Spraying

Another method that may be used to create one or more layers of the backlit luminous structure is spraying. The spraying technique may use equivalent materials as those used in the screen printing technique on the target surface, as the materials for each layer of the UV EL coating stack, such as shown in FIGS. 2A-2B, may be liquid-based. The spraying method may not be as accurate or controllable as the screen printing technique. For example, thickness or uniformity of each layer may vary more than the screen printing technique. However, the spraying technique may be used to more quickly or rapidly apply the layers, which is beneficial for applications where the backlit luminous structure is used in theme parks or otherwise to create large structures glowing structures.

Thermoforming

In some instances, thermoforming may be used to create one or more layers of the backlit luminous structure. For example, one or more layers of the UV emitting coating stack 112A, 112B may be created and then thermoformed onto a 2D or 3D surface. This method allows to form the UV emitting coating on surface with complex geometry and still to achieve the uniform coating.

Thermoforming is a manufacturing process where a sheet of material is heated to an elevated temperature, is positioned over or within a mold, and formed to a specific shape defined by the mold, and then is generally trimmed to create a product. The plastic sheet is heated to a high-enough temperature such that the sheet can be stretched into or onto a mold and then cooled to form a shaped product.

Figure 6:
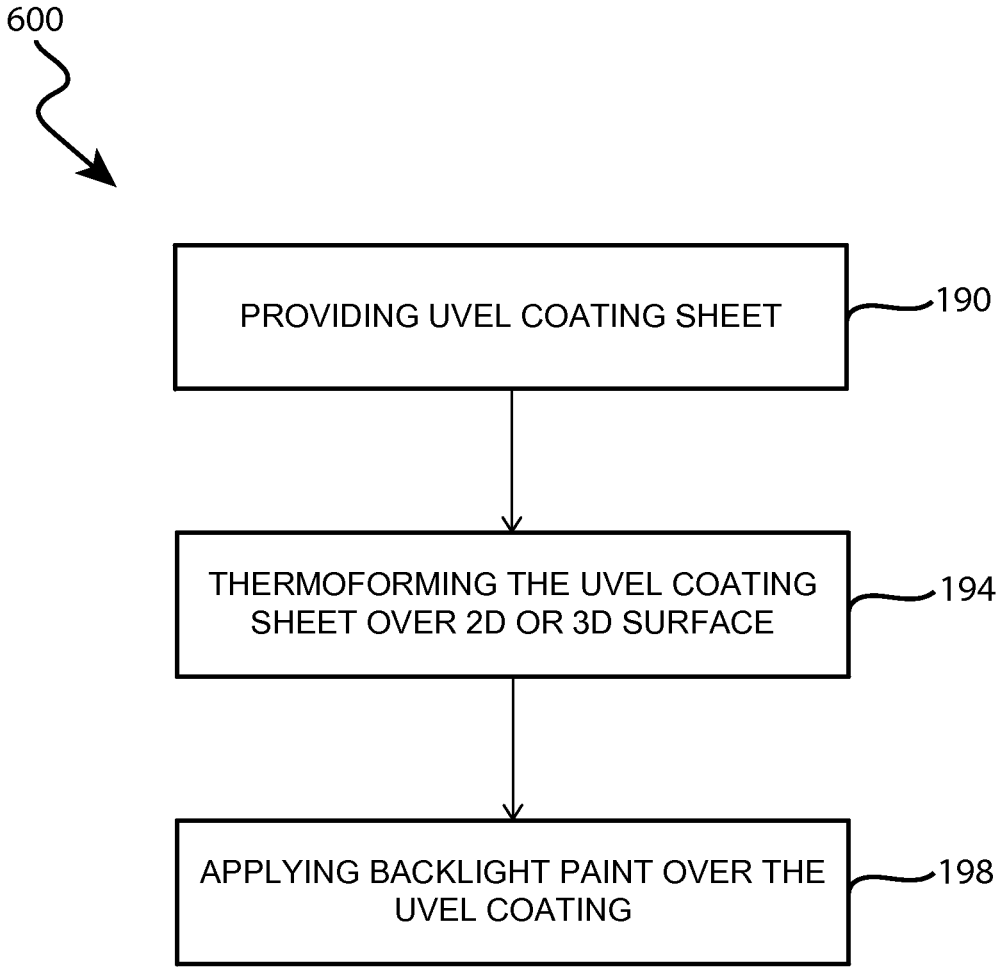
FIG. 6 is a flow chart illustrating steps for thermoforming a UV emitting sheet over a surface in accordance with embodiments of the present disclosure.

FIG. 6 is a flow chart illustrating steps for thermoforming a UV emitting coating sheet over a 2D or 3D surface in accordance with embodiments of the present disclosure. Method 600 may include providing a UV emitting coating sheet at operation 190. The UV emitting coating sheet may use a polymer, such as polycarbonate or polyester as the insulating base layer 122. The UV emitting coating sheet may be formed by using screen printing or spraying method as disclosed earlier with respect to FIG. 5. The UV emitting coating sheet is flexible and stretchable.

Method 600 may also include thermoforming the UV emitting coating sheet over a 2D or 3D surface at operation 194. Method 600 may further include applying fluorescent paint over the UV emitting coating sheet at operation 198. The fluorescent paint may then be applied over the UV emitting coating sheet by an artist. The fluorescent paint, such as Wildfire luminescent paints, may have high UV pigment concentration, which makes them "glow" or emit visible light in response to exposure to UV light.

A specific example of thermoforming using a vacuum process will now be discussed. FIG. 7A is a cross-sectional view of the 2D surface with the UV emitting coating sheet in accordance with embodiments of the present disclosure. As shown, the fluorescent paint 206 is applied on the top of a UV emitting coating sheet 204, which may emit UV light upon activation, causing the fluorescent paint to emit visible light. The UV emitting coating sheet 204 is thermoformed onto a substrate 202.

Figure 7B:
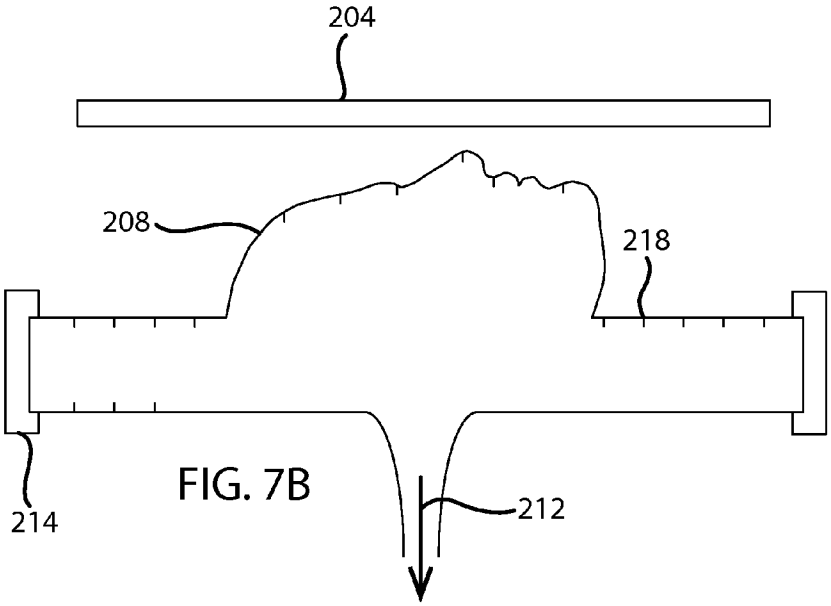
FIG. 7B is a side view of the UV emitting sheet prior to be thermoformed to a 3D surface in accordance with embodiments of the present disclosure.
Figure 7A:
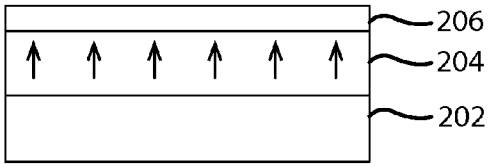
FIG. 7A is a cross-sectional view of a 2D surface with the UV emitting sheet in accordance with embodiments of the present disclosure.

FIG. 7B shows a side view of the UV emitting coating sheet prior to be thermoformed to a 3D surface in accordance with embodiments of the present disclosure. As shown in FIG. 7B, the UV emitting coating sheet 204 is vacuum-formed into a 3D surface 210 as shown in FIG. 7B by a mold 208, which includes a 3D mold surface, for example, a contour of a human face or any 3D object. The shape and contours of the mold surface determine the final formed shape of the UV emitting coating sheet 204 and are selected based on the desired application for the formed surface. For example, the 3D mold surface may be shaped to include the features of a character's face, e.g., nose, mouth, etc. The mold 208 also includes a flat base portion 218 surrounding the 3D mold surface. The mold 208 may be formed of cast aluminum, machined aluminum or composite.

When the UV emitting sheet 204 is positioned over the mold 208, the mold 208 may be vacuumed by a vacuum pump 212 to pull the UV emitting coating sheet 204 against the outer surface of the mold 208. Because the UV emitting coating sheet 204 may be heated, the vacuum causes the sheet 204 to conform against the outer surface of the mold 208, matching the contours of the mold surface. Often, a frame 214 may be used to hold the edge of the sheet 204 to the mold 208 during the vacuum process to help prevent the sheet 204 from moving relative to the mold 208.

Figure 7D:
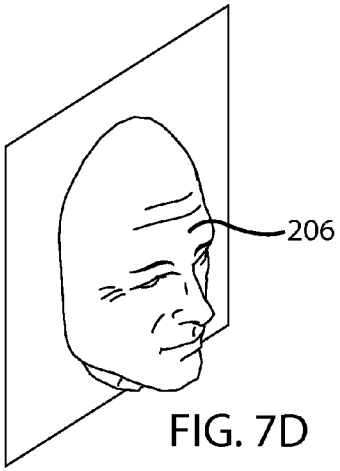
FIG. 7D illustrates a perspective view of the UV emitting sheet thermoformed 3D surface of FIG. 7C covered with luminous paint.
Figure 7C:
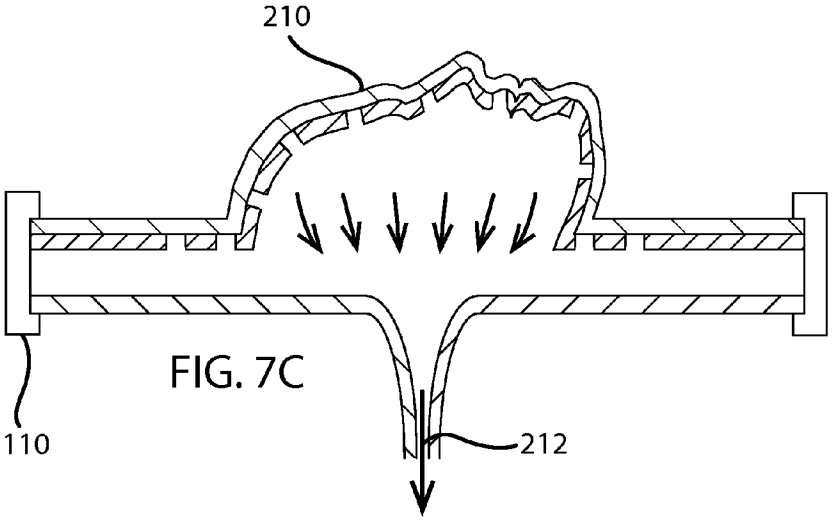
FIG. 7C is a side view of the UV emitting sheet thermoformed to the 3D surface of FIG. 7B.

FIG. 7C shows a side view of the UV emitting coating sheet thermoformed to the 3D surface of FIG. 7B. As shown, the sheet 204 is molded into a 3D surface 210, which may be trimmed on the edges. FIG. 7D illustrates a perspective view of the UV emitting coating sheet thermoformed 3D surface of FIG. 7C covered with fluorescent paint. As shown, blacklight paint 206 is applied to cover the 3D surface 210 of the UV emitting coating sheet.

Figure 8:
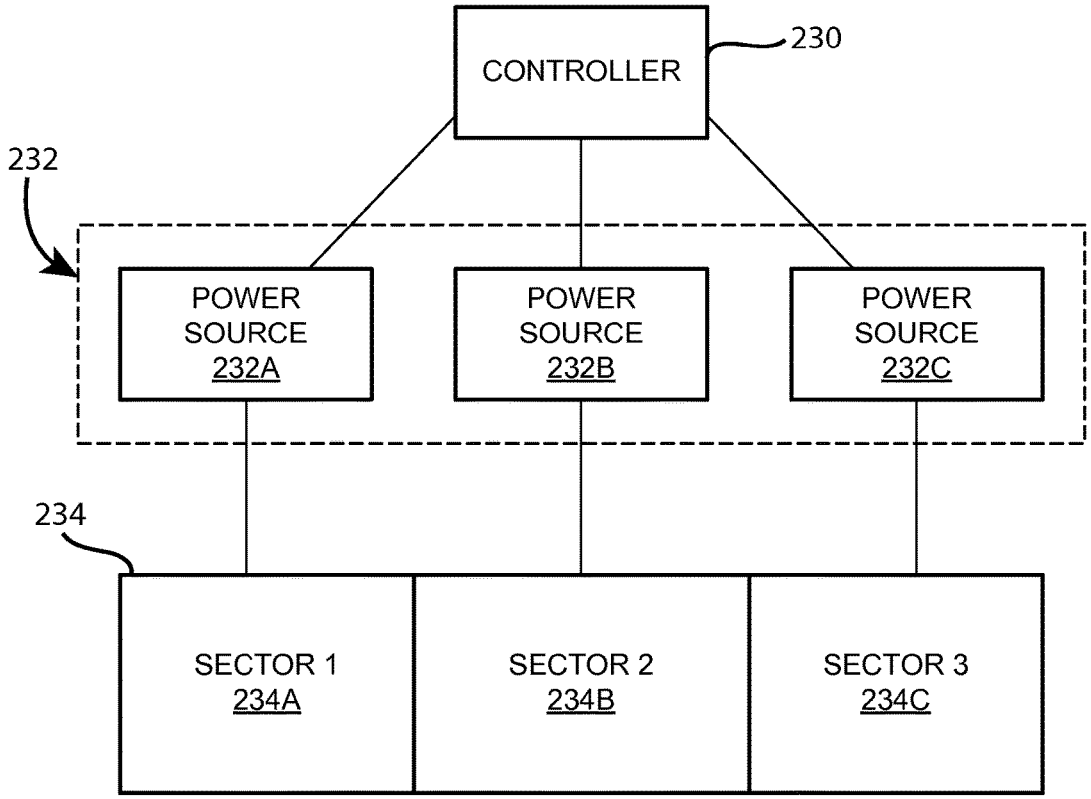
FIG. 8 illustrates a simplified system diagram for controlling the backlit luminous structure in accordance with embodiments of the present disclosure.

FIG. 8 illustrates a simplified system diagram for controlling a 2D or 3D surface emitting visible light in accordance with embodiments of the present disclosure. System 800 includes a controller 230 coupled to a number of power sources 232A-C, which are electrically coupled to corresponding region or sections 234A-B. The controller 230 may control each of the power sources to selectively activate one or more sections or regions. One or more of the regions 234A-C may be narrow or pointed, such as nose region of a human or animal character. By using different power sources, the electric current may be varied for different regions. For example, to enhance brightness in selected areas, one may increase electric current from the power source. Alternatively or additionally, select sections may be activated or deactivated separate from other sections.

Other Embodiments

In other embodiments, the UV emitting coating may use a light source that does not include phosphors. For example, in some embodiments the UV emitting coating may include OLEDs, LEDs, micro LEDs, LECs, or the like. In these embodiments, the light sources may be arranged in pixels or another layout that provides a desired light emission arrangement. The UV light source for the backlit luminous structure may be substantially any type of light emitting element or elements, such as components or chemicals that react to emit radiation within the desired wavelengths. In these embodiments, the backlit luminous structure may be similar to the embodiments shown in FIG. 2A or may be varied based on the activation method needed for the particular UV emitting source. Additionally, the reflectors and/or filters may be used with these embodiments to create the desired artistic effect.

Applications

The backlit luminous structure backlights the luminous paint, which helps to ensure that the UV light that reaches the paint is not shadowed by either external objects or by the shape of the structure itself. This helps to provide uniform illumination of the painted surface and thus a more uniform effect and/or tailored effect. For example, because the UV light is emitted from beneath the fluorescent paint layer, the concentration of the UV can be precisely determined. The present technique provides the flexibility in creating colors in an artistic way and glowing differently in various regions to create desired artistic effects.

A few example applications for the backlit luminous structure will now be discussed. The backlit luminous structure may be used to illuminate features within an amusement park attraction or theme park attraction. For example, elements within an attraction may be lit by the backlit luminous structure such as animatronic characters, scene elements such as set features, plants, accessories or tools, buildings, or the like. The various display or scene elements that are illuminated using the backlit luminous structure are may be self-illuminated and have an aesthetic glowing characteristic. Because the backlit luminous structure is self-illuminating and the UV light is produced internally, scenic elements can have complex shapes and still have uniform illumination. Additionally, guests can touch the structures, walk around the structures, and the like without shadowing the UV light and thus not disrupt or effect the artistic appearance of the scenic elements.

Figure 9:
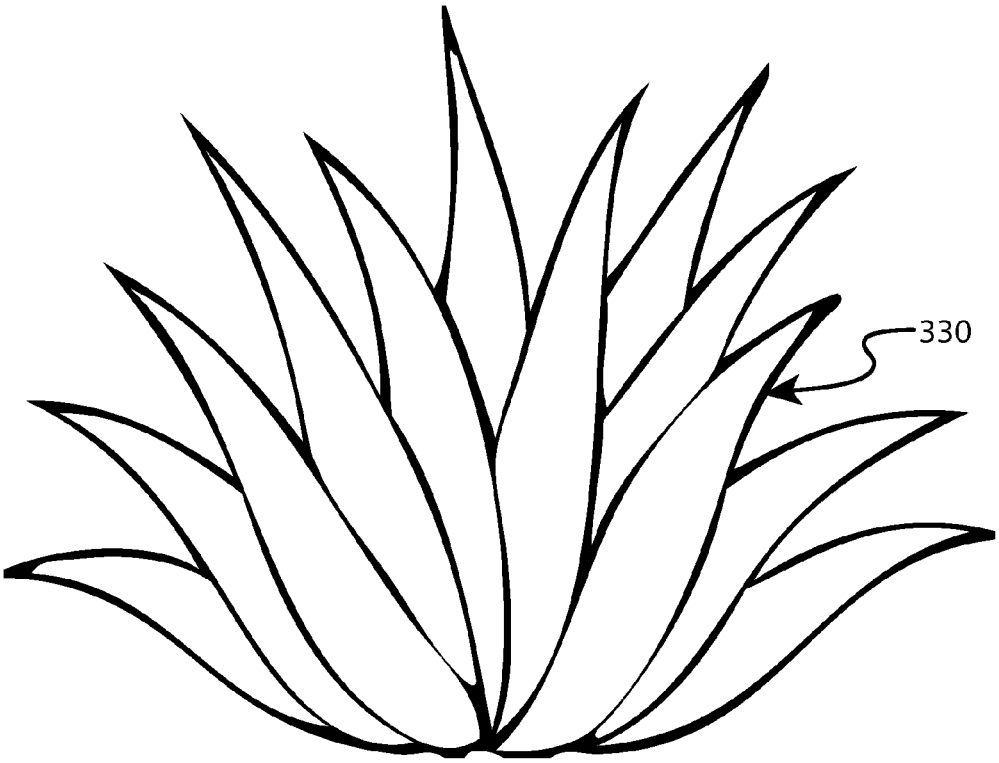
FIG. 9 is a front elevation view of a scenic 3D element formed with the backlit luminous structure.

One example of a scenic element that can be illuminated with the backlit luminous structure is plants, such as flowers, trees, shrubs, or leaves. Structures including leaves or other complicated geometries are typically difficult to light by external UV lamps due to the their complex shapes and the shadowing that occurs with the placement of different levels of leaves, other structures, or the like. By applying the UV emitting coating on both sides of each leaf and then painting fluorescent paint over the UV emitting coatings, the leaves are illuminated on both sides. FIG. 9 illustrates a tree scenic element 330 created with the backlit luminous structure. By using the backlit luminous structure, guests can touch the leaves, bark, or other portions of the scenic element without changing the appearance of the scenic element as the UV light is generated within the structure and external shadows do not affect the UV light emission and thus do not hinder the visible light emitted by the fluorescent paint.

Figure 10:
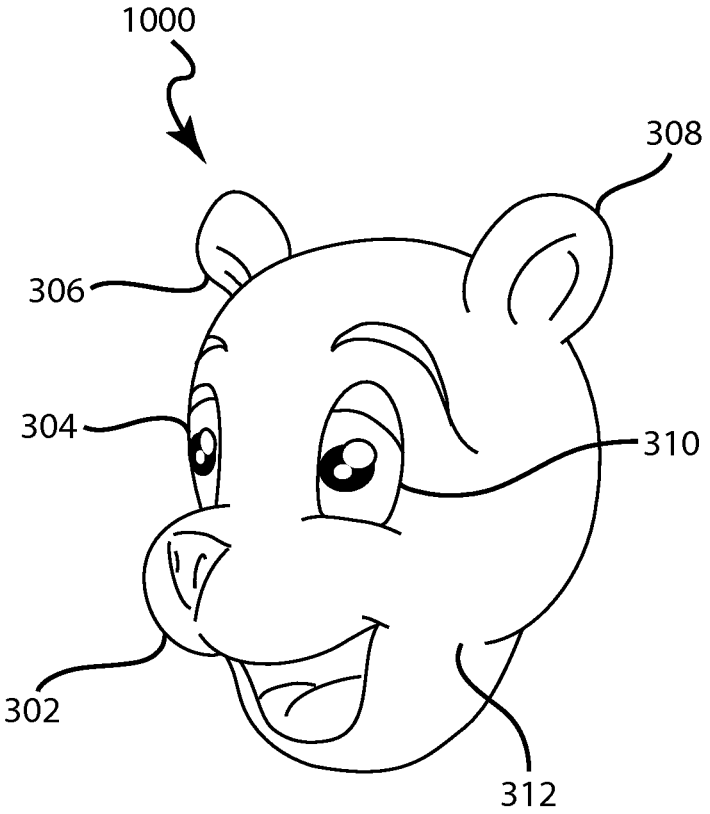
FIG. 10 is a perspective view of a character formed with the backlit luminous structure including a plurality of selectively activatable regions.

Another application for the backlit luminous structure is the illumination of elements requiring precise light control. The backlit luminous structure allows for narrow surface control, such as point-to-point control, which can be used to illuminate small regions of a scenic element. For example, the nose of a face or animal character as shown in FIG. 10 can be illuminated by the backlit luminous structure. With reference to FIG. 10, a bus bar may be positioned around the nose region of the character to control the illumination of the nose independently from other regions of the character that are also illuminated with the backlit luminous structure. This type of control and small area illumination is difficult, if not impossible, with external UV light source.

As yet another example of an application, motion effects may be created with scenic elements created with the backlit luminous structure. For example, the surface of the scenic element may include a set or number of sectors as shown in FIG. 10. One sector 302 may be activated as a starting point and different sectors 304, 306, 308, 310, or 312 may be activated sequentially or in another manner so that light propagates from the starting point to each of the other sectors, creating an aesthetic effect. The motion may be frozen quickly by using the electrical control. The ability to electrically activate selected regions to glow may make easy to provide animated lighting.

A further application is that that the ability to discretely illuminate scenic elements. With conventional blacklight structures, external UV lights are required to illuminate the painted structure and as describe above, the UV radiation may scatter and impact other structures or people. Additionally, the external UV lamps may be positioned in such a manner that guests may have to walk between the UV lamp and the illuminated surface to experience the ride. In both examples, the UV light may impact the guest and may not reach the blacklight paint, reducing or eliminating the visible light emitted from the paint. However, because the backlit luminous structure is internally lit with UV light, the UV light can be controlled and inadvertent illumination of guests or other structures is reduced or eliminated, such that glowing aesthetic of the scenic element is not affected by the external shadows.

Conclusion

In methodologies directly or indirectly set forth herein, various steps and operations are described in one possible order of operation but those skilled in the art will recognize the steps and operation may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A backlit luminous structure, comprising:

a substrate;

an ultraviolet (UV) emitting coating applied to the substrate that when activated emits UV light; and a UV activated luminous coating applied over the UV emitting coating.

2. The backlit structure of claim 1, wherein the UV emitting coating comprises:

an insulating layer positioned on the substrate;

a bottom conducting layer positioned on the insulating layer;

a dielectric layer positioned on the conducting layer;

one or more phosphor layers positioned over the dielectric layer, wherein the one or more phosphor layers comprise phosphors that when activated emit UV light; and a top conducting layer positioned over the one or more phosphor layers.

3. The backlit structure of claim 2, wherein the UV emitting coating further comprises a UV transparent coat positioned on the top conducting layer.

4. The backlit structure of claim 2, wherein the phosphor layers comprise a first phosphor layer including a first type of phosphor and a second phosphor layer including a second type of phosphor.

5. The backlit structure of claim 4, wherein the coating further comprises a filter layer positioned between the top conducting layer and the first phosphor layer and the second phosphor layer, wherein the filter transmits UV light and blocks visible light.

6. The backlit structure of claim 2, wherein the coating further comprises at least one conducting strip positioned between the bottom conducting layer and the dielectric layer.

7. The backlit structure of claim 1, wherein the UV emitting coating comprises a plurality of electrically isolated regions, wherein each of the electrically isolated regions is independently activated.

8. The object of claim 2, wherein the one or more phosphor layers comprises a first phosphor layer containing a first phosphor covering a first region of the substrate and a second phosphor layer containing a second phosphor covering a second region of the substrate.

9. The object of claim 2, wherein the UV light emitted has a wavelength less than 400 nm.

10. The object of claim 2, wherein the top conducting layer comprises conductive particles in a resin matrix and is transparent to UV light.

11. The object of claim 10, wherein the conducting particles comprise silver nanowires.

12. The object of claim 10, wherein the conducting particles are smaller than UV wavelengths.

13. The object of claim 2, wherein the coat on the top conducting layer is transparent to UV light.

14. An illumination system for an object comprising:

an ultra violet (UV) emitting structure comprising a plurality of selectively activatable UV regions;

a blacklight paint coat applied on top of the UV emitting structure;

a power source electrically coupled to a plurality of regions; and a controller electrically coupled to the power source to independently activate UV emission from each UV region of the plurality of UV regions.

15. The system of claim 14, wherein the UV emitting structure comprises:

an insulating layer;

a bottom conducting layer position on the insulating layer, wherein the bottom conducting layer is divided into a plurality of conducting regions corresponding to the plurality of UV regions;

a dielectric layer positioned over the conducting layer;

one or more phosphor layers positioned over the dielectric layer, the phosphors, when activated, emitting light wavelengths in the UV spectrum; and a top conducting layer positioned over the dielectric layer.

16. The system of claim 15, wherein the top conducting layer is transparent to UV wavelengths.

17. The system of claim 15, wherein the UV emitting structure further comprises a clear coat positioned over the top conducting layer, wherein the blacklight paint coat is applied on the clear coat.

18. A method for forming a fluorescent illuminating object comprising:

applying an electroluminescent ultra violet emitting (UV EL) coating onto a substrate, wherein the UV EL coating comprises a plurality of ultra violet activated phosphors; and applying UV activated pigments over the UV EL coating.

19. The method of claim 18, wherein applying the UV EL coating comprises screening printing or spraying each of the following layers sequentially:

(a) an insulating base layer over the substrate;

(b) a bottom conducting layer over the insulating base layer;

(c) a dielectric layer over the bottom conducting layer;

(d) one or more layers containing phosphors over the dielectric layer;

(e) a top conducting layer over the one or more layers containing phosphors; and (g) a top coat layer over the top conducting layer.

20. The method of claim 19, wherein each of the top conducting layer and the top coat layer are transparent to at least one or more UV light wavelengths.

21. The method of claim 19, wherein the one or more layers containing phosphors further comprises a first phosphor layer over a first region of dielectric layer and a second phosphor layer over a second region of the dielectric layer.

22. The method of claim 21, wherein the first region partially overlaps with the second region.

23. The method of claim 21, wherein the first region does not overlap with the second region.

24. The method of claim 19, further comprising thermoforming the UV EL coating over the substrate.

* * * * *